US005297319A

United States Patent [19]

Akashi et al.

[11] Patent Number: 5,297,319

[45] Date of Patent: Mar. 29, 1994

[54] SLIDE FASTENER

[75] Inventors: Shunji Akashi; Tsutomu Yonezawa; Masahiro Kusayama, all of Toyama, Japan

[73] Assignee: Yoshida Kogyo K. K., Tokyo, Japan

[21] Appl. No.: 971,945

[22] Filed: Nov. 5, 1992

[30] Foreign Application Priority Data

Nov. 5, 1991 [JP] Japan ..... 3-318328

[51] Int. Cl.[5] ..... A44B 19/00

[52] U.S. Cl. ..... 24/405; 24/408; 24/413

[58] Field of Search ..... 24/405, 406, 407, 408, 24/409, 413, 404, 403, 399, 392, 393

[56] References Cited

U.S. PATENT DOCUMENTS 2,264,324 12/1941 Morin ..... 24/413
2,264,325 12/1941 Morin ..... 24/413
2,264,326 12/1941 Morin .
2,264,327 12/1941 Morin .
2,264,580 12/1941 Morin ..... 24/403
3,132,398 5/1964 Schwendt et al. ..... 24/408
3,977,053 8/1976 Takamatsu ..... 24/413
4,140,157 2/1979 Scott ..... 24/408
4,562,621 1/1986 Takeshima et al. ..... 24/413

*Primary Examiner*—Victor N. Sakran
*Attorney, Agent, or Firm*—Hill, Steadman & Simpson

[57] ABSTRACT

A slide fastener comprising: a pair of woven or knitted stringer tapes having a pair of core threads extending in and along their confronting inner longitudinal edges; a pair of rows of die-cast coupling elements mounted on and along the confronting inner longitudinal edges; and each of said stringer tapes including a conductive wire extending along the respective core thread on its side toward the inner longitudinal edge, an edge warp yarn extending along the inner longitudinal edge, and a weft yarn having a succession of turnover portions arranged along the inner longitudinal edge, said conductive wire together with said edge warp yarn being incorporated into each said stringer tapes by said turnovers in such a manner that said conductive wire is partially concealed with said edge warp yarn and said turnover portions.

8 Claims, 4 Drawing Sheets

SLIDE FASTENER

BACKGROUND OF THE INVENTION

1. Field of the Invention

This invention relates to a slide fastener having die-cast coupling elements treated by an electrochemical surface treatment such as electrolyte plating or electrodeposition painting.

2. Description of the Related Art

In the manufacture of slide fasteners, it is currently known to treat a plurality of metal coupling elements with electrochemical surface treatment such as electrotytic plating or electrodeposition painting, after the coupling elements are mounted on a pair of stringer tapes at regular distances along their confronting inner longitudinal edges. In this case, the electrochemical surface treatment is done while an electric current is conducted to the individual coupling elements; for this purpose, a conductive wire is incorporated in the inner longitudinal tape edge on which the successive coupling elements are mounted.

This prior art is exemplified by Japanese Utility Model Publications Nos. SHO 39-8208 and SHO 59-7136 and U.S. Pat. No. 2,264,324 (Cl. 204-23), in which the conductive wire is situated alongside a core thread extending along the inner longitudinal tape edge or is wound around such a core thread. According to these prior art publications, the conductive wire is attached to the outside edge of the core thread, projecting from the peripheral surface of the core thread.

In the case where the metallic coupling elements are die-cast, the stringer tape is held between upper and lower mold halves, and then molten metal is introduced into the mold to form a plurality of coupling elements on the stringer tape at equal distances along the inner longitudinal edge. The upper and lower mold halves have grooves extending between the individual cavities for forming the coupling elements; the grooves serves to receive the inner longitudinal edge of the stringer tape during die-casting. The contour of the grooves must be such that the conductive wire bites into the core thread so as not to project from the grooves. With the conductive wire projecting from the grooves, the upper and lower mold halves cannot be brought into intimate contact with each other. In the foregoing prior art, however, the projected portion of the conductive wire would be caught between the groove edges of the upper and lower mold halves and hence would possibly be cut off so that electrolytic plating will be impossible. Since the conductive wire is exposed along the entire length of the core thread, thus impairing the appearance of the slide fastener as a finished product.

SUMMARY OF THE INVENTION

It is therefore an object of this invention to provide a slide fastener in which a conductive wire can be received within grooves of upper and lower mold halves reliably without being caught between the groove edges.

According to the invention, there is provided a slide fastener comprising: a pair of woven or knitted stringer tapes having a pair of core. threads extending in and along their confronting inner longitudinal edges; a pair of rows of die-cast coupling elements mounted on and along the confronting inner longitudinal edges; and each of the stringer tapes including a conductive wire extending along the respective core thread on its side toward the inner longitudinal edge, an edge warp yarn extending along the inner longitudinal edge, and a weft yarn having a succession of turnover portions arranged along the inner longitudinal edge, the conductive wire together with the edge warp yarn being incorporated into each the stringer tapes by the turnovers in such a manner that the conductive wire is partially concealed with the edge warp yarn and the turnover portions.

DETAILED DESCRIPTION

Figure 1:
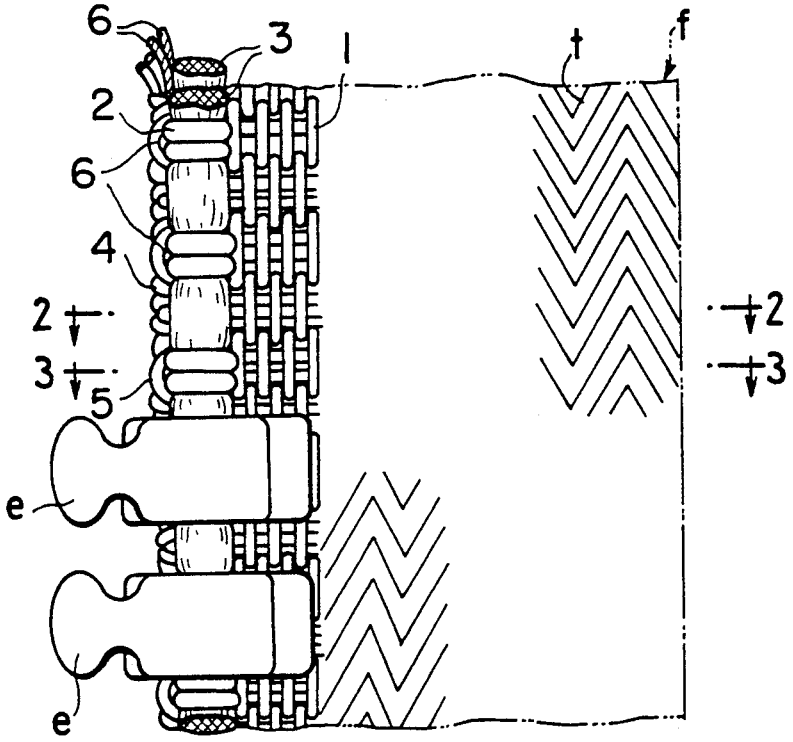
FIG. 1 is a plan view of a fastener stringer having a woven stringer tape according to this invention.
Figure 2:
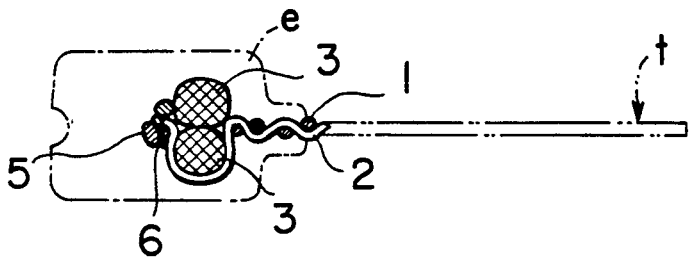
FIG. 2 is a cross-sectional view taken along line A—A of FIG. 1.
Figure 3:
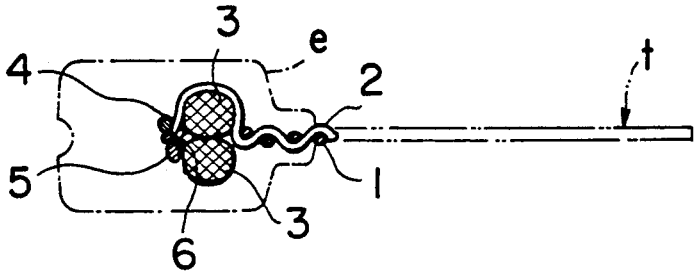
FIG. 3 is a cross-sectional view taken along line B—B of FIG. 1.

FIG. 1 shows a woven fastener stringer f as one embodiment of this invention. The fastener stringer f includes a tape t woven of plural warp yarns 1 and a weft yarn 2. The stringer tape t has on front and rear surfaces a pair of core threads 3, 3 woven with the weft yarn 2 along one longitudinal tape edge simultaneously with the weaving of the stringer tape f, and an edge warp yarn 5 laid in successive turnover portions 4 of the weft yarn 2 which are arranged along the one longitudinal tape edge. In FIGS. 1 through 3 the edge warp yarn 5 and the turnover portions 4 of the weft yarn 2 are shown as projecting from the core threads 3; but actually they bite into the core threads 3 with substantially no projection over the circumferential surfaces of the core threads 3 to form a beaded edge having a substantially circular cross section so that the resulting stringer tape t can be sandwiched between upper and lower mold halves (not shown) reliably without any obstacle when a succession of coupling elements e are to be formed by die-casting.

Figure 4:
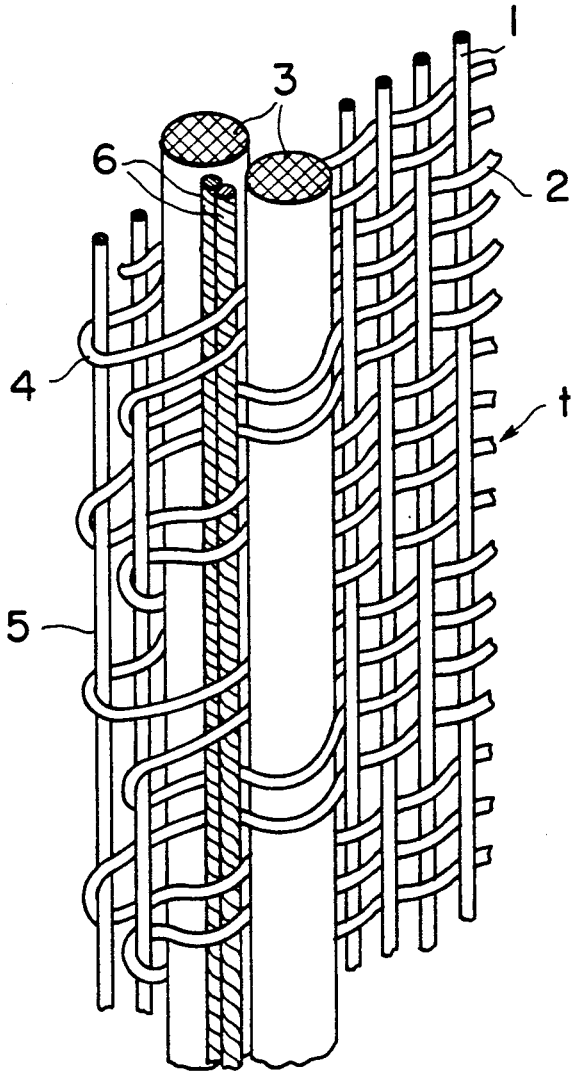
FIG. 4 is an exploded perspective view of the woven structure of the fastener stringer.

The woven structure of the stringer tape t may be any of various kinds of known structures. As is apparent from FIG. 4, a pair of conductive wires 6 are woven with the weft yarn 2 as inserted between the edge warp yarn 5 and the core threads 3 simultaneously with the inserting of the edge warp yarn 5. As shown in FIGS. 2 and 3, the conductive wires 6 are drawn against the core threads 3 by the edge warp yarn 5 and the turnover portions 4 of the weft yarn 2 and are concealed thereby so as to be only partially exposed from the texture woven of the edge warp yarn 5 and the turnover portions 4 of the weft yarn 2. However the exposed wire portions do not stand out on either the edge warp yarn 5 or the turnover portions 4 of the weft yarn 2 but only exist inside the woven texture.

Figure 5:
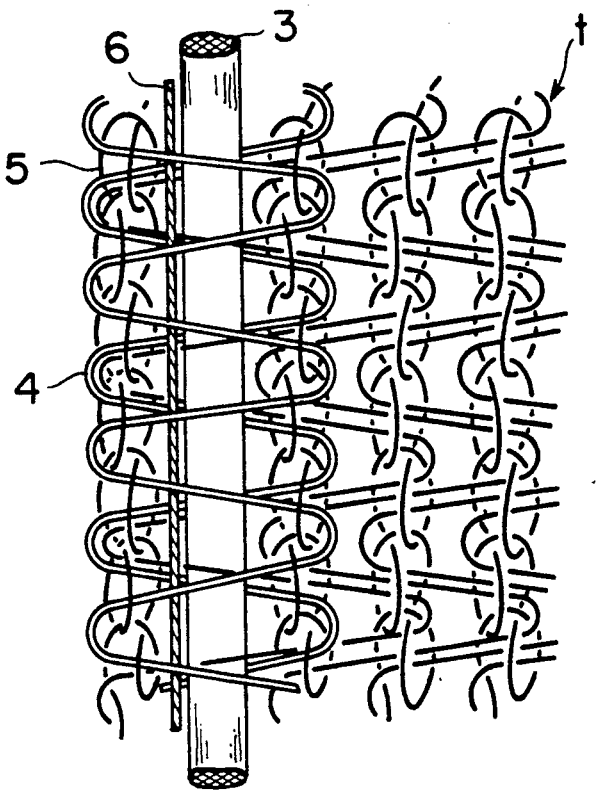
FIG. 5 is a plan view of a modified fastener stringer having a knitted stringer tape according to the invention.
Figure 6:
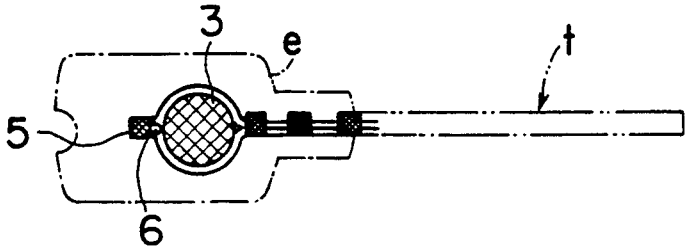
FIG. 6 is a fragmentary cross-sectional view of the fastener stringer of FIG. 5.

FIG. 5 shows a knitted stringer tape t whose structure includes a core thread 3 laid in and along a longitudinal tape edge, a conductive wire 6 inlaid in parallel to the core thread 3, an edge warp yarn 5, and tightening weft yarns 2 having along the longitudinal tape edge a succession of turnover portions 4 knitted with the edge warp yarn 5 in such a manner that the conductive wire 6 is concealed thereby so as to be only partially exposed from the knitted texture. However the exposed wire portions do not stand out on either the edge warp yarn 5 or the turnover portions 4 of the weft yarns 2 but only exist inside the knitted texture.

In order to have a flexibility, the conductive wire 6 may be a suitable fiber thread with a conductive foil or wire such as of copper wound around the fiber thread. Preferably a set of two conductive wires should be inserted.

Even when the foregoing stringer tape t is sandwiched between die-casting mold halves, any core thread portion is prevented from being caught by the groove edges of the mold halves and is hence free from any damage. Further, during the die-casting, since molten metal penetrates into the woven or knitted texture of the stringer tape t to join with the conductive wire 6 integrally, an electric current can be conducted to the individual die-cast coupling elements e reliably during a subsequent electrolytic plating process.

According to the slide fastener of this invention, partly since the conductive wire the edge warp yarn are inserted in the stringer tape along the circumferential surface of the core threads, and partly since the inlaid conductive wire is concealed by the edge warp yarn and the turnover portions of the weft yarn so as to be exposed only partially, the conductive wire does not stand out on the outer surfaces of the stringer tape as protected by the edge warp yarn and the turnover portions of the weft yarn. With this arrangement, when the stringer tape is sandwiched between the mold halves, any part of the conductive wire is kept from contacting the groove edges of the mold halves so that an electric current can be conductive to every coupling element, thus causing an improved yield of production. Furthermore, since the conductive wire inserted in the stringer tape is concealed so as to be seen scarcely from outside, it is possible to improve the appearance of the slide fastener.

What is claimed is:

1. A slide fastener comprising: a pair of woven or knitted stringer tapes each having a core thread extending in and along their confronting inner longitudinal edges; a row of die-cast coupling elements mounted on and along the confronting inner longitudinal edges; and each of said stringer tapes including a conductive wire extending along the respective core thread on its side toward the inner longitudinal edge, an edge warp yarn extending along the inner longitudinal edge, and a weft yarn having a succession of turnover portions arranged along the inner longitudinal edge, said conductive wire together with said edge warp yarn being incorporated into each of said stringer tapes by said turnovers in such a manner that said conductive wire is partially concealed by said edge warp yarn and said turnover portions.

2. A slide fastener according to claim 1, wherein each of said stringer tapes comprises an additional conductive wire extending along the core thread, said succession of turnover portions of said weft yarn arranged to incorporate said additional conductive wire into said stringer tape.

3. A slide fastener according to claim 1, wherein each of said stringer tapes comprises an additional core thread extending in and along the confronting inner longitudinal edges on a side of each said stringer tapes opposite one of said core threads, and an additional conductive wire extending along the respective additional core thread on its side toward the inner longitudinal edge, said succession of turnover portions of said weft yarn arranged to incorporate said additional conductive wire into said stringer tape.

4. A slide fastener according to claim 1, wherein each of said stringer tapes comprises an additional core thread extending in and along the confronting inner longitudinal edges of a side of each said stringer tapes opposite one of said core threads, and an additional conductive wire extending along the respective additional core thread on its side toward the inner longitudinal edge, and an additional edge warp yarn extending along the inner longitudinal edge, said succession of turnover portions of said weft yarn arranged to incorporate said additional warp yarn and said additional conductive wire into said stringer tape.

5. A slide fastener comprising: a pair of woven or knitted stringer tapes each having a core thread extending in and along their confronting inner longitudinal edges; a row of die-cast coupling elements mounted on and along the confronting inner longitudinal edges; and each of said stringer tapes including a conductive wire extending along the respective core thread, an edge warp yarn extending along the inner longitudinal edge, and a weft yarn having a succession of turnover portions arranged along the inner longitudinal edge, said conductive wire together with said edge warp yarn being incorporated into each of said stringer tapes by said turnovers in such a manner that said conductive wire is partially concealed by said edge warp yarn and said turnover portions.

6. A slide fastener according to claim 5, wherein each of said stringer tapes comprises an additional conductive wire extending along the core thread, said succession of turnover portions of said weft yarn arranged to incorporate said additional conductive wire into said stringer tape.

7. A slide fastener according to claim 5, wherein each of said stringer tapes comprises an additional core thread extending in and along the confronting inner longitudinal edges on a side of each said stringer tapes opposite one of said core threads, and an additional conductive wire extending along the respective additional core thread, said succession of turnover portions of said weft yarn arranged to incorporate said additional conductive wire into said stringer tape.

8. A slide fastener according to claim 5, wherein each of said stringer tapes comprises an additional core thread extending in and along the confronting inner longitudinal edges on a side of each said stringer tapes opposite one of said core threads, and an additional conductive wire extending along the respective additional core thread, and an additional edge warp yarn extending along the inner longitudinal edge, said succession of turnover portions of said weft yarn arranged to incorporate said additional warp yarn and said additional conductive wire into said stringer tape.

* * * * *